US009413067B2

(12) United States Patent
Klemes

(10) Patent No.: US 9,413,067 B2
(45) Date of Patent: Aug. 9, 2016

(54) SIMPLE 2D PHASE-MODE ENABLED BEAM-STEERING MEANS

(71) Applicant: Huawei Technologies Co., Ltd., Shenzhen (CN)

(72) Inventor: Marek Klemes, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 777 days.

(21) Appl. No.: 13/870,309

(22) Filed: Apr. 25, 2013

(65) Prior Publication Data

US 2014/0266901 A1 Sep. 18, 2014

Related U.S. Application Data

(60) Provisional application No. 61/778,097, filed on Mar. 12, 2013.

(51) Int. Cl.

| | |
|---|---|
| ***H01Q 3/36*** | (2006.01) |
| ***H01Q 21/22*** | (2006.01) |
| ***H01Q 21/00*** | (2006.01) |

(52) U.S. Cl.

CPC ..... *H01Q 3/36* (2013.01); *H01Q 21/0031* (2013.01); *H01Q 21/22* (2013.01)

(58) Field of Classification Search

CPC ..... H01Q 3/36; H01Q 21/22; H01Q 21/0006

See application file for complete search history.

(56) References Cited

U.S. PATENT DOCUMENTS 4,616,230 A * 10/1986 Antonucci ..... H01Q 25/02 342/152
5,473,294 A * 12/1995 Mizzoni ..... H01P 5/04 333/113
2008/0238774 A1 10/2008 Ratni
2009/0280750 A1 11/2009 Rofougaran et al.

FOREIGN PATENT DOCUMENTS

EP 1050926 A2 8/2000

OTHER PUBLICATIONS

International Search Report and Written Opinion of the International Searching Authority received in Patent Cooperation Treaty Application No. PCT/US2014/073275 mailed Jun. 11, 2014, 12 pages.

(Continued)

*Primary Examiner* — Gregory C Issing
(74) *Attorney, Agent, or Firm* — Slater Matsil, LLP

(57) ABSTRACT

System and apparatus embodiments are provided for beam-steering. In an embodiment, an apparatus includes a first hybrid splitter/combiner connected to a 0-th phase-mode feed of an array of antenna elements, a second hybrid splitter/combiner, a first pair of variable phase shifters connecting the first hybrid splitter/combiner to the second hybrid splitter/combiner, wherein the first pair of variable phase shifters control a steering direction of a main output beam radial with respect to an array axis by adjustments of respective phases of the variable phase shifters, and wherein the array axis is perpendicular to a plane of the array, and a third variable phase shifter connecting a 1-st phase-mode feed of an array of elements to an input of the first hybrid splitter/combiner, wherein the third variable phase shifter is configured to independently control a direction of the main output beam in a direction circumferential with respect to the array axis.

25 Claims, 7 Drawing Sheets

(56) References Cited

OTHER PUBLICATIONS

Sheleg, B., "A Matrix-Fed Circular Array for Continuous Scanning," Proceedings of the IEEE, Nov. 1968, 13 pages, vol. 56, Issue 11.
Davies, D.E.N., "Electronic steering of multiple nulls for circular arrays," Electronic Letters, Oct. 27, 1977, pp. 669-670, vol. 13, Issue 22.
Khanna, R. et al., "Adaptive Beam Forming Using a Cascade Configuration," Aug. 1983, IEEE Transactions on Acoustics, Speech, and Signal Processing, pp. 940-945, vol. ASSP-31, Issue 4.
Ko, C.C., "Adaptive array processing using the Davies beamformer," Dec. 1986, IEEE Proceedings, Microwaves, Antennas & Propagation, pp. 467-473, vol. 133, Pt. H, Issue 6.
Cvetkovic, M., "A Four Element Circular Array Direction Finding and Null Steering System," Antennas and Propagation, 1989. ICAP 89., Sixth International Conference, Toronto, Apr. 4-7 1989, pp. 168-172, vol. 1.
Sibille, A. et al., "Beam Steering Circular Monopole Arrays for Wireless Applications," $10^{th}$ International Conference on Antennas and Propogation, Apr. 14-17, 1997, pp. 358-361, vol. 1.
Gross, F., "Smart Antennas for Wireless Communications with Matlab," 2005, 288 pages, The McGraw-Hill Companies, Inc.
Chang, C.C. et al., "Design of Beam Switching/Steering Butler Matrix for Phased Array System," IEEE Transactions on Antennas and Propogation, Feb. 2010, pp. 367-374, vol. 58, Issue 2.
Moulder, W. et al., "60-GHz Two-Dimensionally Scanning Array Employing Wideband Planar Switched Beam Network," IEEE Antennas and Wireless Propagation Letters, IEEE, 2010, 4 pages, vol. 9.

* cited by examiner

SIMPLE 2D PHASE-MODE ENABLED BEAM-STEERING MEANS

CROSS-REFERENCE TO RELATED APPLICATIONS

The present application claims the benefit of U.S. Provisional Patent Application No. 61/778,097 filed Mar. 12, 2013 and entitled "Simple 2D Phase-Mode Assisted Beam-Steering Means," which is incorporated herein by reference as if reproduced in its entirety.

TECHNICAL FIELD

The present invention relates to antennas and electromagnetic radiation modification, and, in particular embodiments, to systems and methods for steering the direction of the main lobe of a radiation pattern effected by antennas.

BACKGROUND

Beam-steering is the angular positioning of the main lobe of a radiation pattern. This allows for greater discrimination in favor of a desired signal from a point-like source in the far field of the antenna, for sensing or information transmission and reception. When it is required to steer the beam of a planar array antenna over a limited range in 2 dimensions around the array axis (which is perpendicular to the plane of the array), it becomes difficult to fit each element with a variable phase shifter or transceiver module (TR), and incorporate them all into the feed structure as would be devised in the conventional approach. This is especially true where the wavelengths involved are small because the array elements and spacings scale with wavelength (must be in the order of half wavelength) whereas feed lines and phase shifters take up additional room and do not completely scale with wavelength, (especially TRs). In any case, the phaseshifters and TRs become very expensive for short wavelengths (e.g. millimeter-waves), so it is desirable to use as few of them as possible to achieve the necessary beam control.

SUMMARY OF THE INVENTION

In accordance with an embodiment, an apparatus for beam-steering includes a first hybrid splitter/combiner connected to a 0-th phase-mode feed of an array of antenna elements, a second hybrid splitter/combiner, wherein an output of the second splitter/combiner comprises a main output beam, a first pair of variable phase shifters connecting the first hybrid splitter/combiner to the second hybrid splitter/combiner, wherein the first pair of variable phase shifters control a steering direction of the main output beam radial with respect to an array axis by adjustments of respective phases of the variable phase shifters, wherein the respective phases are equal in magnitude and opposite in sign, and wherein the array axis is perpendicular to a plane of the array, and a third variable phase shifter connecting a 1-st phase-mode feed of an array of elements to an input of the first hybrid splitter/combiner, wherein the third variable phase shifter is configured to independently control a direction of the main output beam in a direction circumferential with respect to the array axis.

In accordance with another embodiment, a receiving and/or transmitting system for radiation beam-steering includes a first port connected to a 0-th order phase-mode feed of an array of radiation transducer elements, a second port connected to a +1-st order phase mode feed of the array, a first pair of variable phase shifters comprising a first variable phase shifter and a second variable phase shifter, a third variable phase shifter connected to second port, a first equal-amplitude hybrid splitter/combiner connected to the first pair of variable phase shifters, to the third variable phase shifter, and to the first port, and a second equal-amplitude hybrid splitter/combiner connected to the first pair of variable phase shifters, wherein the third variable phase shifter is configured to independently control a direction of a main output beam in a direction circumferential with respect to an array axis, and wherein the first pair of variable phase shifters are configured to be controlled in equal magnitudes and opposing signs effecting steering of a radiation beam in a radial direction around an axis perpendicular to a plane of the array.

In accordance with yet another embodiment, an apparatus for beam-steering includes a first hybrid splitter/combiner connected to a 0-th phase-mode feed of an array of antenna elements, a second hybrid splitter/combiner, wherein an output of the second splitter/combiner comprises a resultant array beam, a first pair of variable phase shifters connecting the first hybrid splitter/combiner to the second hybrid splitter/combiner, wherein the first pair of variable phase shifters control a steering direction of a main output beam radial with respect to an array axis by adjustments of respective phases of the variable phase shifters, wherein the respective phases are equal in magnitude and opposite in sign, and wherein the array axis is perpendicular to a plane of the array, a second pair of variable phase shifters, wherein a first one of the second pair of variable phase shifters is connected to a +1-st phase-mode feed of the array of antennas and a second one of the second pair of variable phase shifters is connected to a −1-st phase-mode feed of the array of antennas, and a third hybrid splitter/combiner connected to the second pair of variable phase shifters and connected to the first hybrid splitter/combiner, wherein the second pair of variable phase shifters are configured to adjust their respective phases by an equal magnitude and an opposite sign, wherein the second pair of variable phase shifters are controllable independently from the first pair of variable phase shifters, and wherein the second pair of variable phase shifters control a scanning the steering of the main output beam in a circumferential direction with respect to the array axis.

BRIEF DESCRIPTION OF THE DRAWINGS

For a more complete understanding of the present invention, and the advantages thereof, reference is now made to the following descriptions taken in conjunction with the accompanying drawings which illustrate, but do not limit the scope of the present invention to, a specific embodiment in which.

DETAILED DESCRIPTION OF ILLUSTRATIVE EMBODIMENTS

Figure 1:
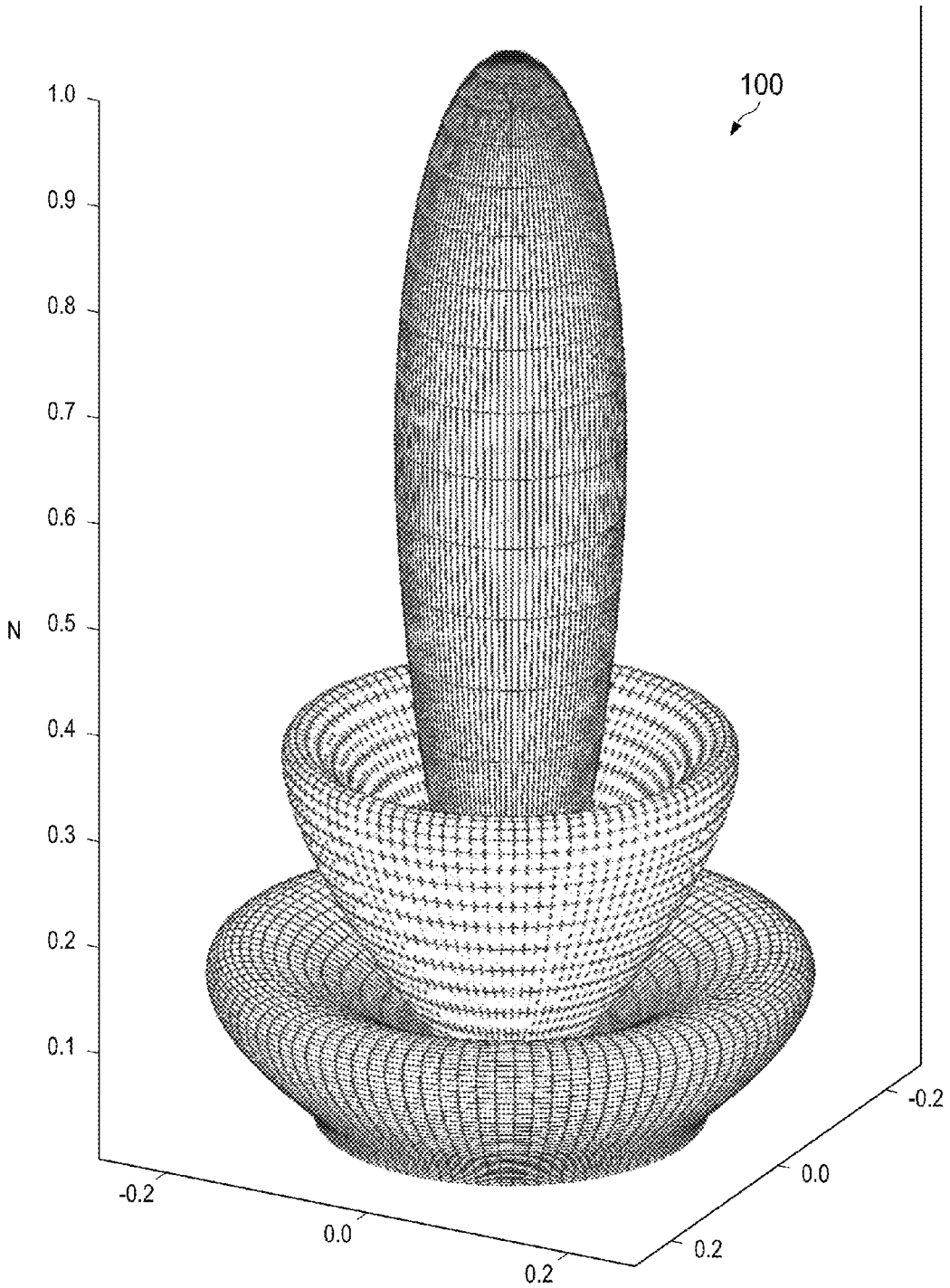
FIG. 1 is a graph illustrating a far-field pattern of 0-th order phase-mode $P_0$ of a 16 element, $\lambda/2$ spaced circular ring array.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Disclosed herein is a 2 dimensional (2D) phase-mode beam steering system that achieves 2D steering of the electromagnetic (EM) radiation beam of a circular or polygonal ring array of an arbitrary number of antenna elements using a fixed number of variable phase shifters and hybrid splitter/combiners. The fixed number of phase-modes are implemented in the feed structure of the antenna ring array. The different phase-modes may each use a separate concentric ring array of antennas or they may use a common ring array of antennas for any or all of the phase-modes. The number of variable phase shifters and the number of hybrid splitters/combiners is independent of the number of antenna elements used. The disclosed 2D phase-mode beam steering systems and apparatuses may be connected to a phase-mode feed network. Additional information about phase-mode feed networks and about hybrid splitters/combiners may be found in Davies, D. E. N. and Rizk, M. S. A. S., "Electronic Steering of Multiple Nulls for Circular Arrays," Electronics Letters, Vol. 13, No. 22, pp. 669-670, 27 Oct. 1977, which is incorporated herein by reference in its entirety.

In an embodiment, the disclosed 2D phase-mode beam steering system achieves 2-dimensional steering of the beam of a circular ring array of any number of antenna elements using only 4 (or optionally 3) variable phase shifters and only 3 (or optionally 2) hybrid splitter/combiners. Only 3 (or optionally 2) phase-modes are required to be implemented in the feed structure of the circular ring array. They may each use a separate concentric ring array or a common one for any or all of the phase-modes. The 0-th order phase-mode may also use a filled planar polygonal array and the +1-st and −1-st phase-modes may use polygonal rings of elements on the periphery of this array; these variations of the geometry are to be understood as being implicit in the term "circular ring array" as used in this description.

Thus the disclosed systems and apparatuses have the potential to greatly reduce the complexity and cost of designing, fabricating and calibrating an electronically-steerable millimeter-wave array antenna. Such an antenna is desirable, for example, in a small-cell backhaul radio to enable automatic alignment of the point-to-point link, thus greatly reducing the link deployment time and cost.

In an embodiment, a beam-steering system includes an analog radio frequency (RF) beam-steering network connected to a circular ring array of radiating (or receiving) elements connected to a phase-mode feed network having output ports for the 0-th, 1-st and −1-st order phase-modes ($P_0$, $P_1$ and $P_{-1}$, respectively), and to a transceiver (with optionally up to 2 additional receiver inputs) at its output ports. The phase-mode inputs to the beamsteering network may be generated from separate concentric ring arrays, or from a single common ring array, having an arbitrary number of elements. The disclosed beam-steering network includes 2 phaseshifters connected to the $P_1$ and $P_{-1}$ phase-modes and controlled in opposite directions, θ and −θ, respectively. These are in turn connected to a hybrid splitter/combiner which forms their sum at one output, $C=P_1e^{j\theta}+P_{-1}e^{-j\theta}$, and difference at the other output, as $D=P_1e^{j\theta}-P_{-1}e^{-j\theta}$. Output of mode $P_0$ is input to a compensating and 90° phaseshift network with the same insertion delay, loss and phase as the phase-shifters and hybrid of the other two phase-modes (when set to zero variable phases). Output D and the compensated $P_0$ mode are then input to another sum/difference hybrid, whose outputs C and D are connected to another two oppositely-adjustable phaseshifters, ϕ and −ϕ, respectively. The outputs of these are then connected to the inputs of a third hybrid whose sum output port C gives the steered main beam for use in the main transceiver, and difference output D gives a steered auxiliary beam for use in an auxiliary receiver. Sum port output C of the first hybrid gives another independent auxiliary beam for use in a second auxiliary receiver, both auxiliary receivers being optional.

In an embodiment, steering of the main beam in a limited range around the array axis (direction perpendicular to the plane of array) in the radial direction is accomplished with phase-setting of ϕ, and in the circumferential direction with setting of θ, independently is provided. The same structure of beam-steerer can be used with ring arrays having any number of elements.

The disclosed beam-steerers are herein described in greater detail of their principles of operation, in the context of a steerable millimeter-wave array antenna. Specifically, in an embodiment, the antenna includes a planar ring of identical radiating (or receiving) elements connected to a phase-mode beamforming network and radiating nominally in the direction orthogonal to the plane of the array (along the array axis).

In the case of an electromagnetic antenna, the array elements maybe of linear or circular polarizations. In the latter case, they may be arranged with their feedpoints symmetrically around the center, so that the phase will progress linearly around the circumference by one cycle, resulting in one of the 1-st order phase modes. In an embodiment, phasing arrangements compensating for this phase-progression will form the 0-th order phase mode. Other phase-mode feed arrangements for linearly-polarized elements may be devised, such as portions of a Butler matrix or Rotman lens, spatial or guided-mode feeds and other arrangements employed by those skilled in the art. In an embodiment, the end result is a phase-mode feed structure of a circular or polygonal ring array having output ports corresponding to the 0-th, +1-st and −1-st order phase modes.

Figure 2:
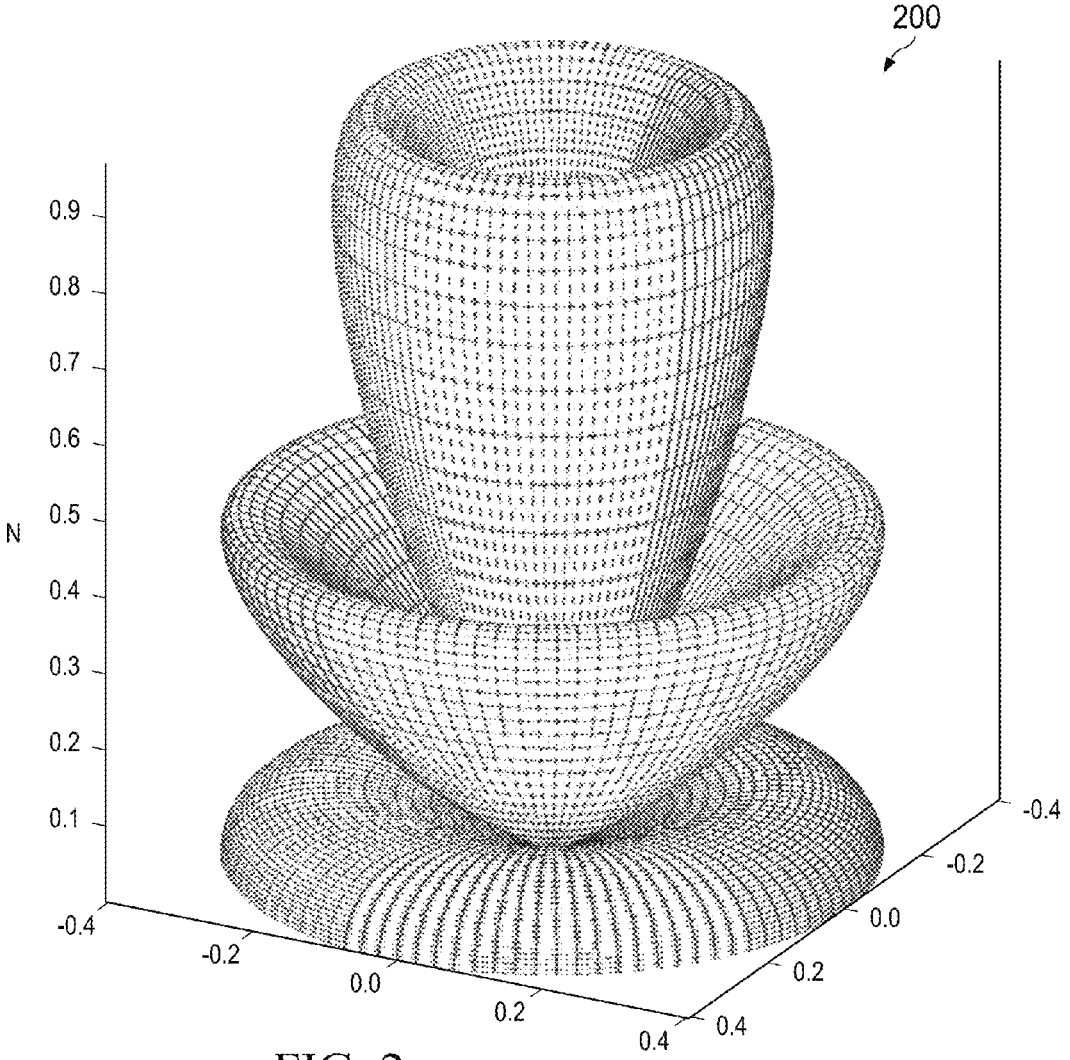
FIG. 2 is a graph illustrating a far-field pattern of −1-st order phase-mode $P_{-1}$ of a 16-element, $\lambda/2$ spaced circular ring array.
Figure 3:
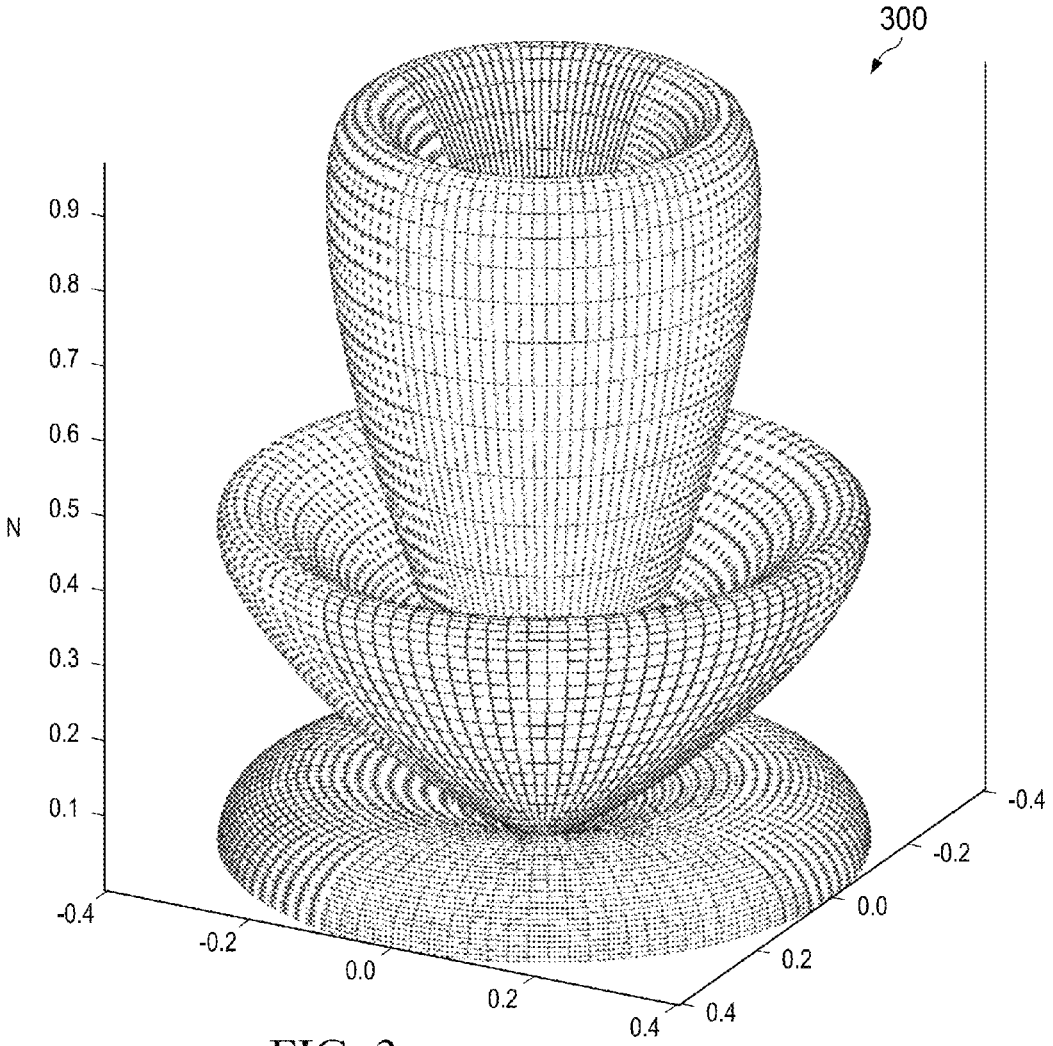
FIG. 3 is a graph of a far-field pattern of 1-st order phase-mode $P_1$ of a 16 element, $\lambda/2$ spaced circular ring array.

To help with the understanding of the operation of the invention, the far-field radiation patterns of the pertinent phase modes are illustrated in FIGS. 1-3. FIG. 1 is a graph 100 illustrating a far-field pattern of 0-th order phase mode $P_0$ of a 16 element, λ/2 spaced circular ring array. FIG. 2 is a graph 200 illustrating a far-field pattern of −1-st order phase-mode $P_{-1}$ of a 16-element, λ/2 spaced circular ring array. FIG. 3 is a graph 300 of a far-field pattern of 1-st order phase-mode $P_1$ of a 16 element, λ/2 spaced circular ring array.

In an embodiment, all antenna elements are assumed to be omnidirectional and linearly polarized for simplicity. In the 0-th order phase mode, $P_0$, there is no phase progression in the element excitations around the circular ring array (all elements are fed in phase), so there is no phase-progression in the circumferential direction around the array (z) axis. Thus all the fields add in-phase on the array axis and form the main beam in the far field. Its normalized plot is shown in FIG. 1 for a 16-element ring array with elements spaced half-wavelength apart around the circumference. Different shading indicates phase, with darker shading denoting −π, lighter shading denoting 0, and medium shading denoting +π radians relative to the $P_0$ excitation. FIGS. 2 and 3 show similar plots for the other phase modes of the same ring array.

The phase progressions in the $P_1$ and $P_{-1}$ modes' far-field patterns are one complete cycle of $2\pi$ radians but in opposite directions around the z-axis, which is the same as their element excitation phase progressions.

Now it will be apparent that if one adds some proportion of, for example, the $P_1$ phase mode to the $P_0$ phase mode, the result will be a main lobe pointing in the direction where the two modes have the same phase (e.g. lighter shade for the above plots). The main lobe will deviate from the array axis by an amount proportional to the proportion of the $P_1$ mode being added. One can also vary the phase, $\theta$, of $P_1$, which will change the location on the circle where it is in phase with the original main beam $P_0$ thus causing the resultant main lobe to point in that direction.

Figure 4:
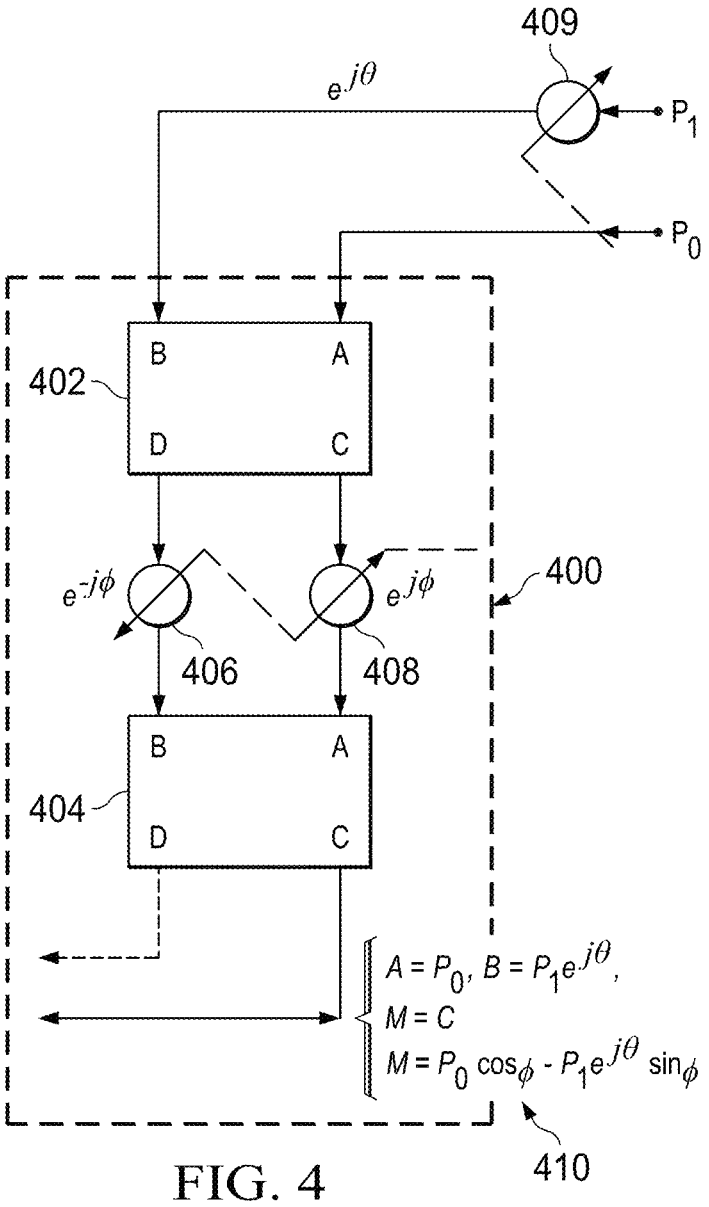
FIG. 4 illustrates an embodiment beam-steerer system with a variable-ratio combiner controlled by setting phaseshift $\phi$, with phaseshift $\theta$ applied to input B.

FIG. 4 illustrates an embodiment beam-steerer system 400 with a variable-ratio combiner controlled by setting phaseshift $\phi$, with phaseshift $\theta$ applied to input B. The system 400 is a variable-ratio combiner. The system 400 includes two hybrid splitters/combiners 402, 404 and two oppositely adjusted phaseshifters 406, 408. Each hybrid splitter/combiner 402, 404 has two inputs, A and B, and two outputs, D and C. The input A for the hybrid splitter/combiner 402 is the $P_0$ phase mode from the far-field of an array of antennas (not shown). The input B for the hybrid splitter/combiner 402 is the $P_1$ phase mode from the far-field of an array of antennas, its phase shifted by phaseshifter 409. The output D of hybrid splitter/combiner 402 is the input for phase shifter 406 and the output C of hybrid splitter/combiner 402 is the input for phase shifter 408. The output from phase shifter 406 is the input B for the hybrid splitter/combiner 404 and the output from phase shifter 408 is the input A for the hybrid splitter/combiner 404. The output D from the hybrid splitter/combiner 404 is the auxiliary output. The output C from the hybrid splitter/combiner 404 is the main (M) output where the steered main beam is effected.

In an embodiment, while the relative phaseshift of the two phase modes is simple to control using a variable phaseshifter 409, their relative proportions of addition are achieved using the variable-ratio combiner of system 400. In this embodiment, the two hybrid splitters/combiners 402, 404 and two oppositely-adjusted phaseshifters 406, 408 are used to realize the function described by the equation 410. The main output, M, is described by the function $$M=P_0\cos\phi-P_1e^{j\theta}\sin\phi,$$

where $\phi$ is the angle of the steered beam around the array axis in the radial direction and $\theta$ is the angle of the steered beam in the circumferential direction.

Figure 5:
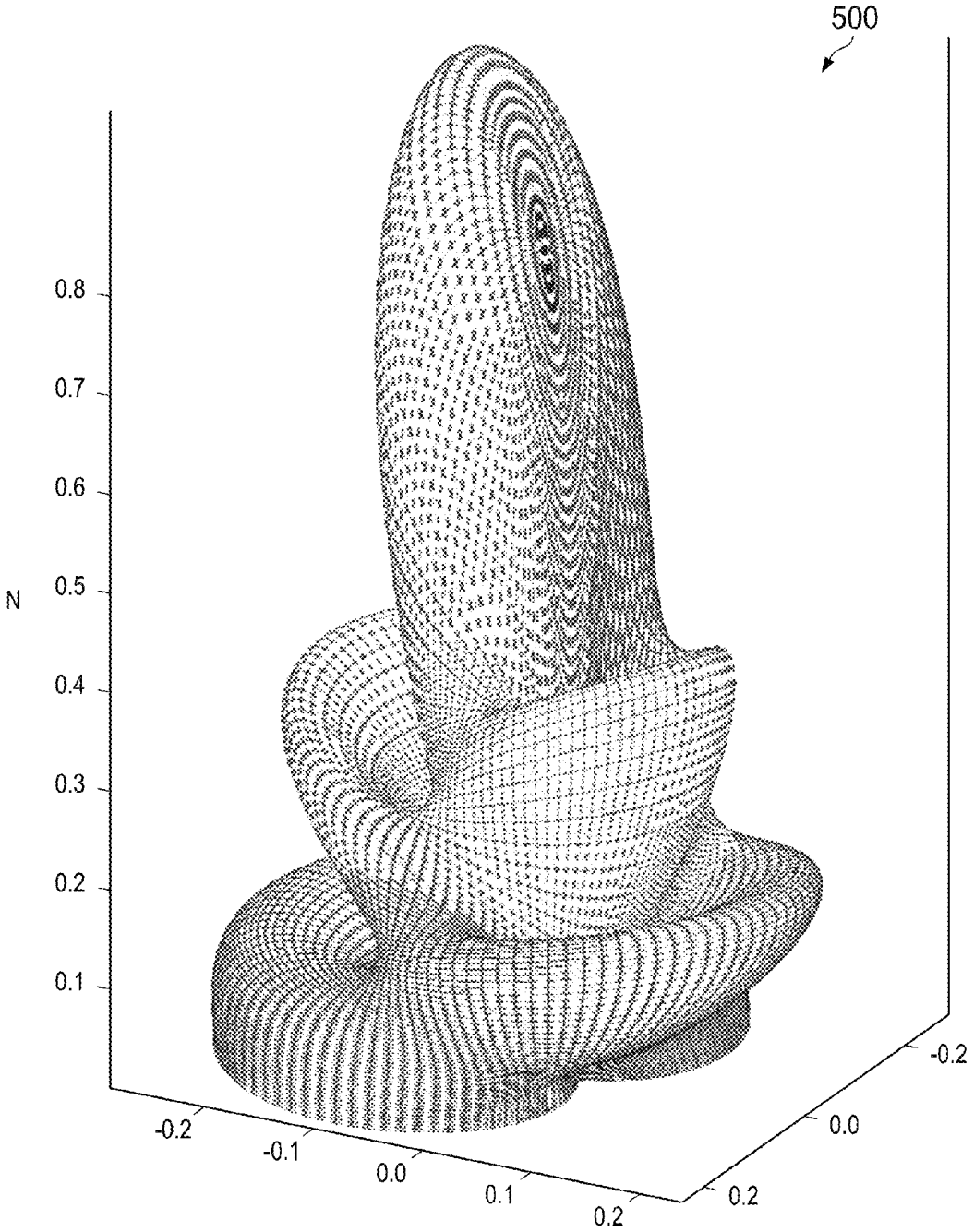
FIG. 5 illustrates a plot of an example of the resultant steered-beam far-field radiation pattern at the main (M) output C from the beam-steerer system of FIG. 4.

Strictly speaking, the mathematics of the equation 410 requires input B to hybrid splitter/combiner 402 to be shifted by a fixed 90 degrees and the (auxiliary) output D of hybrid splitter/combiner 404 also has a fixed 90 degree phaseshift, both of which are of no practical consequence as it depends on the choice of hybrid splitter/combiner in the implementation. An example of the resultant steered-beam far-field radiation pattern 500 at the main (M) output C from hybrid splitter/combiner 404 is shown in FIG. 5 with $\theta=2\pi*0.5$ and $\phi=2\pi*0.125$ radians.

It is possible to obtain a greater steering angle and lower sidelobes in the steered beam by making use of the other first-order phase-mode, $P_{-1}$, by virtue of a simple trigonometric identities as follows.

Suppose the intrinsic phase of phase mode $P_1$ at some angle on the circumference of its main cone is $\alpha$ and its amplitude is $\rho$. Then $P_{-1}$ will have the same amplitude but its phase will be $-\alpha$. Applying phaseshifts $\theta$ and $-\theta$ to these, respectively, results in:

$$P_1e^{j\theta}=\rho e^{j(\alpha+\theta)}=\rho\cos(\alpha+\theta)+j\rho\sin(\alpha+\theta)$$

and $$P_{-1}e^{-j\theta}=\rho e^{j(-\alpha-\theta)}=\rho\cos(-\alpha-\theta)+j\rho\sin(-\alpha-\theta)=\rho\cos(\alpha+\theta)-j\rho\sin(\alpha+\theta)$$

Now, the combined, oppositely-phased first order phase modes produce:

$$P_1e^{j\theta}-P_{-1}e^{-j\theta}=j2\rho\sin(\alpha+\theta)$$

which for any given $\theta$ reaches a maximum value of j2 where $\alpha+\theta=\pi/2$, minimum of $-$j2 where $\alpha$ is such that $\alpha+\theta=-\pi/2$, and is 0 where $\alpha+\theta=\pi$ or 0. Notice that, if we compensate $P_0$ by multiplying it by j, it will always be in phase with the above combined and phaseshifted phase modes. By adding them all together in a variable-ratio combiner, it will result in a peak where the combined modes have a peak, a minimum where they have their minimum, and no effect where they are 0, effecting a steering of the original $P_0$ main lobe in the circumferential direction by roughly twice the amount as with only one 1-st order phase mode, and no "fattening" of the main beam in the directions orthogonal to the direction of steering.

Figure 6:
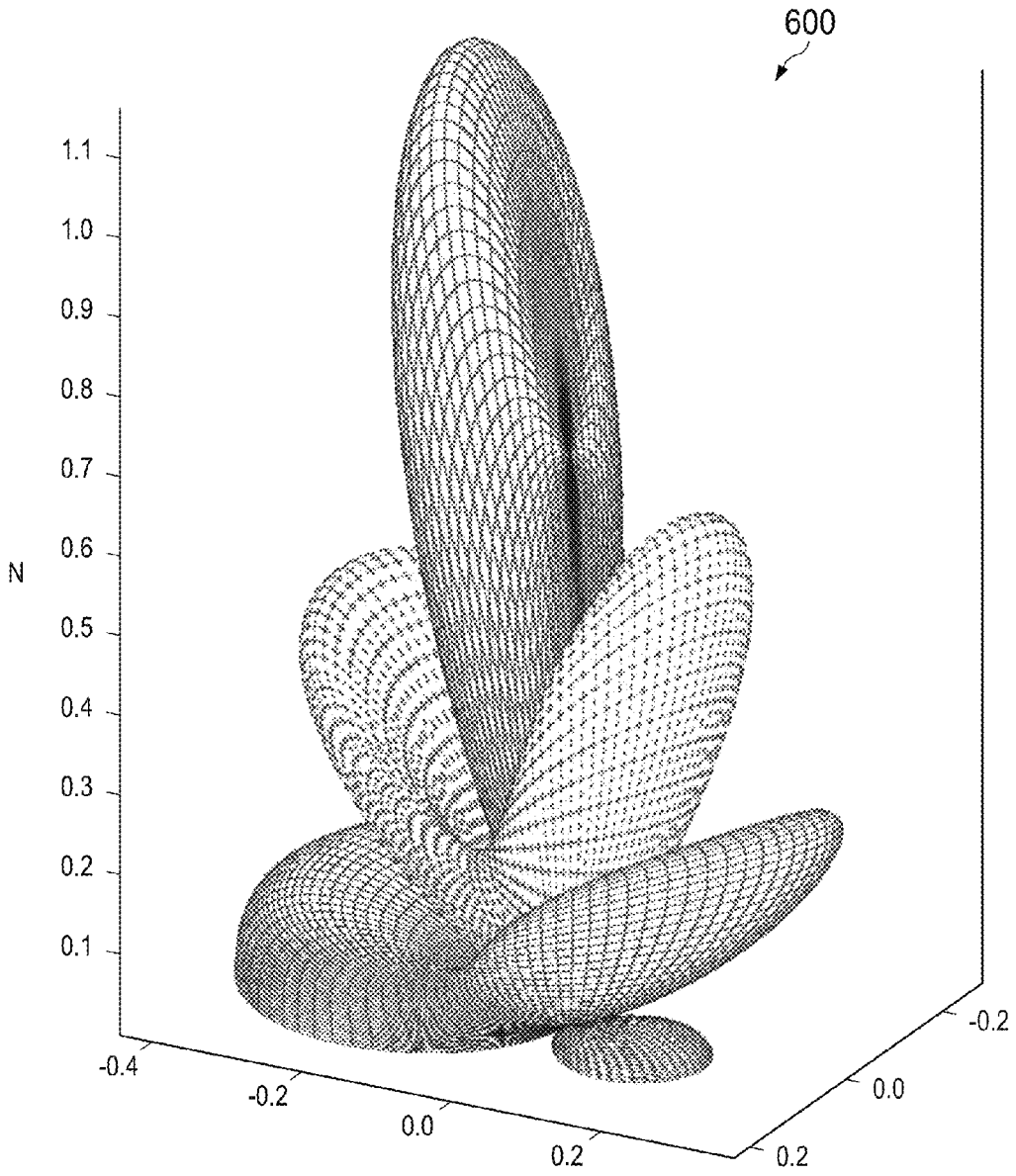
FIG. 6 illustrates a plot of an example of the resultant steered-beam far-field radiation pattern using both first-order phase-modes $P_1$ and $P_{-1}$.

The effect can be seen in the FIG. 6 for the same steering parameters as in FIG. 5. Note the sharper shape of the steered beam and greater tilt in the radial direction corresponding to the control by cp. Its equation is given by:

$$M=P_0\cos\phi-(P_1e^{j\theta}-P_{-1}e^{-j\theta})\sin\phi$$

Note also in FIG. 6 that there is no phase variation over the steered main beam, as in the original main beam due to $P_0$. This means that the modem will not need to track carrier-phase variations as the beam is steered, unlike in the case shown in FIG. 5.

Figure 7:
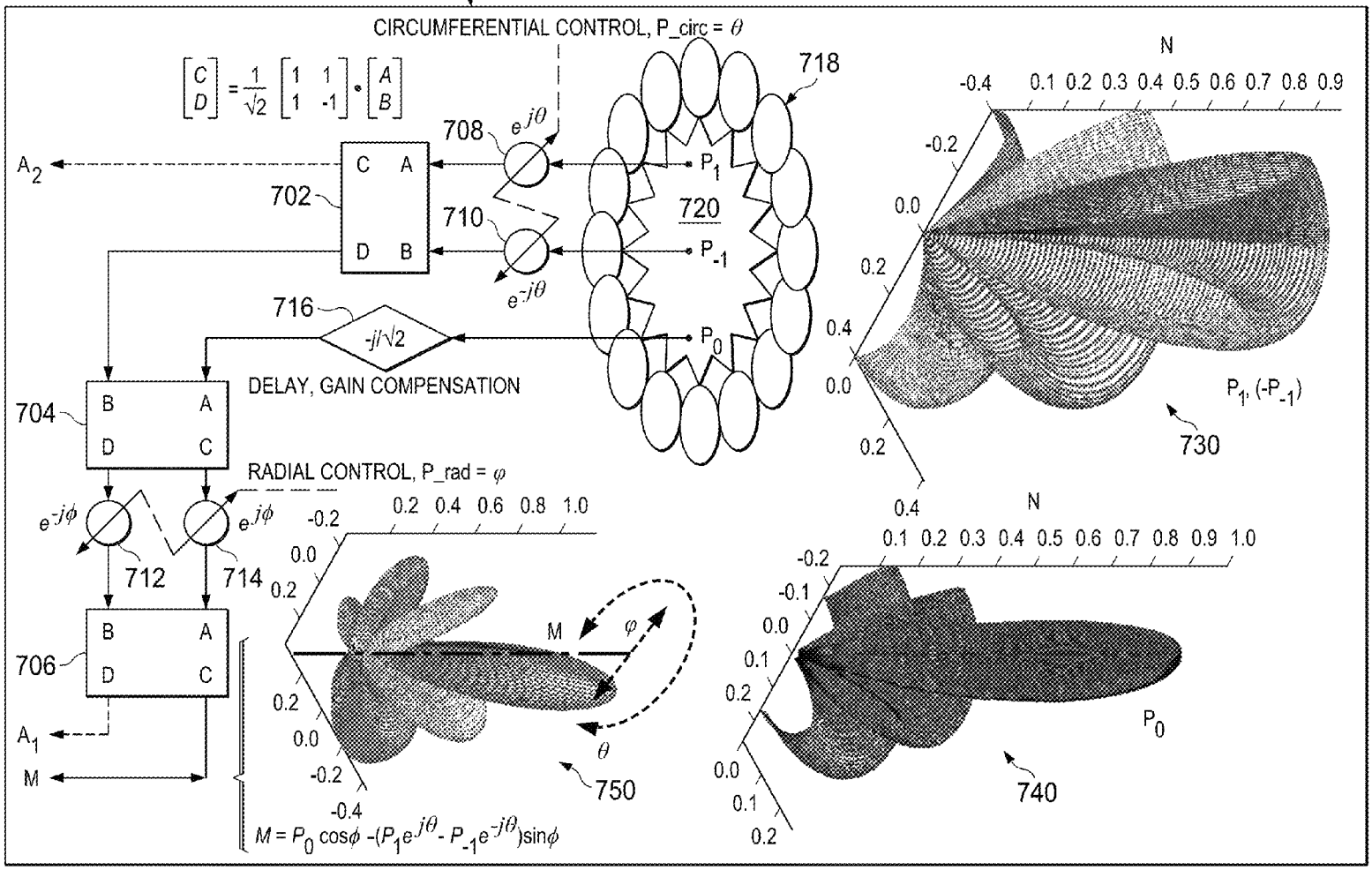
FIG. 7 illustrates an embodiment of the disclosed beam-steering system.

FIG. 7 illustrates an embodiment beam steering system 700. The beam steering system 700 makes use of $P_0$, $P_1$, and Beam steering system 700 includes a circular array of antenna elements 718, a phase mode feed network 720, four phase shifters 708, 710, 712, 714, three hybrid splitters/combiners 702, 704, 706, and a delay and gain compensation module 716. Graph 730 is a cross-section plot of the $P_1$ and $P_{-1}$ components of the phase-mode pattern of the far-field beam received by the array 718. Graph 740 is a cross-section plot of the $P_0$ component of the phase-mode pattern of the far-field beam received by the array 718. Graph 750 is a plot of the steered far-field pattern of the resultant main output C from hybrid splitter/combiner 706, i.e. the output M of the beam steerer 700.

In an embodiment, the circular array of antenna elements 718 may be a polygonal array of antenna elements.

Hybrid splitter/combiner 702 has inputs A and B coupled to variable phase shifters 708 and 710. Variable phase shifter 708 is coupled to the $P_1$ phase mode port of feed 720 of array 718. Variable phase shifter 710 is coupled to the $P_{-1}$ phase mode port of feed 720 of array 718. Variable phase shifters 708, 710 are a phase shifter pair with the phase shift for phase shifter 710 being opposite in sign and equal in magnitude to the phase shift for phase shifter 708. In other words, the phase shifter 708 shifts the phase by the negative of the phase shift provided by phase shifter 710. Phase shifters 708, 710 control the circumferential direction of the main output beam, M.

Hybrid splitter/combiner 702 has outputs C and D that are related to its inputs A and B by the following equation:

$$\begin{bmatrix} C \\ D \end{bmatrix} = \frac{1}{\sqrt{2}} \begin{bmatrix} 1 & 1 \\ 1 & -1 \end{bmatrix} \cdot \begin{bmatrix} A \\ B \end{bmatrix}$$

The output C is a second auxiliary output, A2. The output D is coupled to the B input of hybrid splitter/combiner 704. The outputs C and D of hybrid splitter/combiner 704 are coupled to the respective inputs of phase shifters 712, 714. The phase shifters 712, 714 are paired phase shifters where the direction of phase shift provided by phase shifter 712 is equal in magnitude and opposite in sign to that provided by phase shifter 714. The phase shifters 712, 714 control the radial direction of the main output beam, M. The outputs of the phase shifters 712, 714 are connected to the A and B inputs of the hybrid splitter/combiner 706.

The input A of hybrid splitter/combiner 704 is coupled to a delay, gain compensation unit 716 which shifts the phase by 90 degrees and adjusts the delay and amplitude to match that caused by hybrid splitter/combiner 702. The input of delay, gain compensation unit 716 is coupled to the $P_0$ phase mode of the feed 720 of array 718. The output D of hybrid splitter/combiner 706 is an auxiliary output, $A_1$, and the output C of the hybrid splitter/combiner 706 is the main output, M. The main output M, is given by the following equation:

$$M = P_0 \cos\phi - (P_1 e^{j\theta} - P_{-1} e^{-j\theta}) \sin\phi$$

where $P_0$ is the 0-th order phase-mode input from array 718, $P_1$ is the 1-st order phase-mode input of the array 718, $P_{-1}$ is the −1-st order phase-mode input of the array 718, θ and −θ are phase shifts effected by the phase shifters 708, 710, ϕ and −ϕ are phase shifts effected by the phase shifters 712, 714, and $j=\sqrt{-1}$.

In an embodiment, each of the phase shifters 708, 710, 712, 714 is controllable over a range of +π to −π radians.

The beamsteerer principle using both $P_1$ and $P_{-1}$ can be thought of as amplitude-directed steering because the main lobe of $P_0$ is steered in the direction of the peak of the sinusoidal result of the difference $$P_1 e^{j\theta} - P_{-1} e^{-j\theta} = j2\rho \sin(\alpha+\theta)$$

whereas the principle of the beamsteerer using a single phase-mode $P_{\pm 1}$ is phase-directed steering, as the main lobe is steered in the direction where its phase matches that of the phaseshifted $P_{\pm 1}$ mode.

The auxiliary beams at outputs $A_1$ and $A_2$ may be connected to receivers and used for adaptive nulling of co-channel interference, for spectrum monitoring outside the main beam, for feedback signals in a beam-steering algorithm, or left unused to simplify the hardware by omitting their implementation portions.

Assuming the variable phase shifters 708, 710, 712, 714 are bidirectional, the entire beam steerer system 700 can be used to transmit as well as receive. However, usually just the main beam, M, is used for both transmission (TX) and reception (RX) functions. The hybrid splitter/combiners 702, 704, 706 may be of the sum/difference type or quadrature (also known as branch-line) hybrids with suitable correction of the compensator phase at $P_0$ and insertion of other fixed phase-compensators at the appropriate inputs or outputs of the pertinent hybrid splitter/combiners as determined necessary by those skilled in the art.

In an embodiment, the auxiliary outputs $A_1$ and/or $A_2$ may be connected to transceivers (not shown in FIG. 7) and may be used for spectrum monitoring and/or interference cancellation, or to provide feedback signals to a beam-steering algorithm. The total number of phase shifters 708, 710, 712, 714 and the hybrid splitter/combiners 702, 704, 706 is independent of the number of antenna elements in the antenna array 718.

In an embodiment, the beam steerer system 700 consumes the least amount of analog hardware when implemented at the RF directly, although in principle it can be implemented at intermediary frequency (IF) stages, baseband, or even in digital form. Any implementation other than directly at RF may require coherent receivers and transmitters for each phase-mode port.

In another embodiment, at least the antenna array can be positioned behind the focus (the conventional feed-point) of a lens or reflector, acting as the feed of a lens-based or reflector-based antenna system in order to increase the steering angles and directivity of its beam, by virtue of the magnifying power of such an arrangement. All other components are substantially similar to their corresponding components in FIG. 7.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed is:

1. An apparatus for beam-steering, comprising:

a first hybrid splitter/combiner connected to a 0-th phase-mode feed of an array of antenna elements;

a second hybrid splitter/combiner, wherein an output of the second splitter/combiner comprises a main output beam;

a first pair of variable phase shifters connecting the first hybrid splitter/combiner to the second hybrid splitter/combiner, wherein the first pair of variable phase shifters control a steering direction of the main output beam radial with respect to an array axis by adjustments of respective phases of the variable phase shifters, wherein the respective phases are equal in magnitude and opposite in sign, and wherein the array axis is perpendicular to a plane of the array; and a third variable phase shifter connecting a 1-st phase-mode feed of an array of elements to an input of the first hybrid splitter/combiner, wherein the third variable phase shifter is configured to independently control a direction of the main output beam in a direction circumferential with respect to the array axis.

2. The apparatus of claim 1 further comprising:

a second pair of variable phase shifters, wherein the second pair of variable phase shifters comprises the third variable phase shifter and a fourth variable phase shifter, wherein the third variable phase shifter is connected to a +1st phase-mode feed of the array of antennas and the fourth variable phase shifter is connected to a −1st phase-mode feed of the array of antennas; and a third hybrid splitter/combiner connected to the second pair of variable phase shifters and connected to the first hybrid splitter/combiner, wherein the second pair of variable phase shifters control scanning the steering of the main output beam in a circumferential direction with respect to the array axis.

3. The apparatus of claim 2 further comprising a lens in front of the array.

4. The apparatus of claim 2, wherein control of the first pair of variable phase shifters is independent of control of the second pair of variable phase shifters.

5. The apparatus of claim 2, wherein a first one of the second pair of phase shifters shifts a phase of an input to the first one of the second pair of phase shifters by an amount equal to a negative of the amount by which a second one of the second pair of phase shifters shifts an input to the second one of the second pair of phase shifters.

6. The apparatus of claim 2, wherein each of the phase shifters is controllable over a range of $-\pi$ to $+\pi$ radians.

7. The apparatus of claim 2, wherein a main output of the second hybrid splitter/combiner is described by an equation $M=P_0 \cos\phi-(P_1e^{j\theta}-P_{-1}e^{-j\theta})\sin\phi$ where M is the main output of the second hybrid splitter/combiner, $P_0$ is a 0-th order phase-mode output, $P_1$ is a 1-st order phase-mode output, $P_{-1}$ is a −1-st order phase-mode output, $\theta$ and $-\theta$ are phase shifts effected by the second pair of phase shifters, $\phi$ and $-\phi$ are phase shifts effected by the first pair of phase shifters, and $j=\sqrt{-1}$.

8. The apparatus of claim 7, wherein the outputs are inputs and wherein the apparatus operates in a transmitting mode.

9. The apparatus of claim 2, wherein an auxiliary output of the second hybrid splitter/combiner is described by an equation $A_1=P_0 \sin\phi+(P_1e^{j\theta}-P_{-1}e^{-j\theta})\cos\phi$ where $A_1$ is the auxiliary output of the second hybrid splitter/combiner, $P_0$ is a 0-th order phase-mode output, $P_1$ is a 1-st order phase-mode output, $P_{-1}$ is a −1-st order phase-mode input, $\theta$ and $-\theta$ are phase shifts effected by the second pair of phase shifters, $\phi$ and $-\phi$ are phase shifts effected by the first pair of phase shifters, and $j=\sqrt{-1}$.

10. The apparatus of claim 2, wherein an auxiliary output of the third hybrid splitter/combiner is described by an equation $A_2=P_1e^{j\theta}+P_2e^{-j\theta}$ where $A_2$ is the auxiliary output of the third hybrid splitter/combiner, $P_1$ is a 1-st order phase-mode output, $P_{-1}$ is a −1-st order phase-mode output, $\theta$ and $-\theta$ are phase shifts effected by the second pair of phase shifters, and $j=\sqrt{-1}$.

11. The apparatus of claim 2, wherein a total number of hybrid splitters/combiners and phase shifters is independent of a number of antenna elements in the array.

12. The apparatus of claim 1, wherein the first and second hybrid splitter/combiners are equal amplitude 180-degree or 90-degree hybrid splitter/combiners.

13. The apparatus of claim 1, wherein the array of antennas comprises a circular array of antennas.

14. The apparatus of claim 1, wherein the array of antennas comprises one or more polygonal sub-arrays of antennas.

15. The apparatus of claim 1, wherein each of the phase shifters is controllable over a range of $-\pi$ to $+\pi$ radians.

16. The apparatus of claim 1, wherein a total number of hybrid splitters/combiners and phase shifters is independent of a number of antenna elements in the array.

17. The apparatus of claim 1 further comprising a lens in front of the array.

18. A receiving and/or transmitting system for radiation beam-steering, comprising:

a first port connected to a 0-th order phase-mode feed of an array of radiation transducer elements;

a second port connected to a +1-st order phase mode feed of the array;

a first pair of variable phase shifters comprising a first variable phase shifter and a second variable phase shifter;

a third variable phase shifter connected to second port;

a first equal-amplitude hybrid splitter/combiner connected to the first pair of variable phase shifters, to the third variable phase shifter, and to the first port; and a second equal-amplitude hybrid splitter/combiner connected to the first pair of variable phase shifters, wherein the third variable phase shifter is configured to independently control a direction of a main output beam in a direction circumferential with respect to an array axis, and wherein the first pair of variable phase shifters are configured to be controlled in equal magnitudes and opposing signs effecting steering of a radiation beam in a radial direction around an axis perpendicular to a plane of the array.

19. The system of claim 18 further comprising:

a third port connected to a −1-st order phase mode feed of the array;

a fourth variable phase shifter connected to the third port; and a third equal-amplitude hybrid splitter/combiner connected to the third and fourth variable phase shifters and to the first equal-amplitude hybrid splitter/combiner, wherein the third and fourth variable phase shifters comprise a second pair of variable phase shifters, wherein the second pair of variable phase shifters are configured to be controlled in equal magnitudes and opposing signs independently of the first pair of variable phase shifters, thus effecting steering of the radiation beam in a circumferential direction around an array axis.

20. The system of claim 19 further comprising a main beam port characterized by an equation $M=P_0 \cos\phi-(P_1e^{j\theta}-P_{-1}e^{-j\theta})\sin\phi$ where M represents a signal at a third port of the second hybrid splitter/combiner, $P_0$ represents the signal at a 0-th order phase-mode port, $P_1$ represents the signal at a 1-st order phase-mode port, $P_{-1}$ represents the signal at the −1-st order phase-mode port, $\theta$ and $-\theta$ are phase shifts effected by the second pair of phase shifters, $\phi$ and $-\phi$ are phase shifts effected by the first pair of phase shifters, and $j=\sqrt{-1}$.

21. The system of claim 20, wherein the main beam port is connected to a transceiver.

22. The system of claim 19, further comprising one or more auxiliary ports whose signals are used for feedback to a beam-steering control algorithm, and/or for spectrum monitoring and/or interference cancellation.

23. The system of claim 19, wherein a total number of phase shifters and hybrid splitter/combiners is independent of a number of radiation transducer elements in the array.

24. The system of claim 18, wherein the array comprises one or more of a circular array and a polygonal array.

25. An apparatus for beam-steering, comprising:

a first hybrid splitter/combiner connected to a 0-th phase-mode feed of an array of antenna elements;

a second hybrid splitter/combiner, wherein an output of the second splitter/combiner comprises a resultant array beam; and a first pair of variable phase shifters connecting the first hybrid splitter/combiner to the second hybrid splitter/combiner, wherein the first pair of variable phase shifters control a steering direction of a main output beam radial with respect to an array axis by adjustments of respective phases of the variable phase shifters, wherein the respective phases are equal in magnitude and opposite in sign, and wherein the array axis is perpendicular to a plane of the array;

a second pair of variable phase shifters, wherein a first one of the second pair of variable phase shifters is connected to a +1-st phase-mode feed of the array of antennas and a second one of the second pair of variable phase shifters is connected to a −1-st phase-mode feed of the array of antennas; and a third hybrid splitter/combiner connected to the second pair of variable phase shifters and connected to the first hybrid splitter/combiner, wherein the second pair of variable phase shifters are configured to adjust their respective phases by an equal magnitude and an opposite sign, wherein the second pair of variable phase shifters are controllable independently from the first pair of variable phase shifters, and wherein the second pair of variable phase shifters control a scanning the steering of the main output beam in a circumferential direction with respect to the array axis.

* * * * *